US005456440A

United States Patent [19]

Sideris

[11] Patent Number: 5,456,440

[45] Date of Patent: Oct. 10, 1995

[54] TABLE TOP BOOKSTANDS AND METHOD OF BUILDING THE SAME

[76] Inventor: Xen N. Sideris, 666 Georgia Ave., Palo Alto, Calif. 94306

[21] Appl. No.: 167,514

[22] Filed: Dec. 14, 1993

[51] Int. Cl.[6] ..... A47B 97/04

[52] U.S. Cl. ..... 248/458; 108/27

[58] Field of Search ..... 248/458, 441.1, 248/451, 452, 460; 108/27, 32, 150

[56] References Cited

U.S. PATENT DOCUMENTS

| | | | |
|---|---|---|---|
| 756,631 | 4/1904 | Herbert | 248/448 |
| 936,281 | 10/1909 | Woolsey | 248/458 |
| 1,127,139 | 2/1915 | West | 108/27 X |
| 1,215,588 | 2/1917 | Strauss | 248/453 |
| 1,254,155 | 1/1918 | Parker | 108/27 |
| 1,436,544 | 11/1922 | Starr | 248/349 X |
| 1,438,805 | 12/1922 | Ambler | 108/150 |
| 2,807,908 | 10/1957 | Lykes | 248/451 |
| 3,409,265 | 11/1968 | Wichers | 248/349 X |
| 4,508,306 | 4/1985 | Kemmerer, Jr. . | |
| 5,025,353 | 6/1991 | Menageo | 248/453 X |

FOREIGN PATENT DOCUMENTS 1604417 12/1981 United Kingdom .

OTHER PUBLICATIONS

Dialog™ Computer Database (World Patent Index) Abstract of South African Patent No. 8503727 (Jul. 1, 1986).

*Primary Examiner*—J. Franklin Foss
*Attorney, Agent, or Firm*—Morrison & Foerster

[57] ABSTRACT

A family of table top bookstands is developed from a few elements of different sizes, shapes and characteristics, as well as, optional components. The design centers around a common cylindrical post interfacing between book panel and pedestal.

6 Claims, 3 Drawing Sheets

TABLE TOP BOOKSTANDS AND METHOD OF BUILDING THE SAME

The present invention relates to table top bookstands with optional rotating base and different sizes. The book panel of a bookstand of the present invention is inclined and includes different types of book stops and pedestals.

There are a number of devices known for supporting books of different sizes and weights. These devices have slanted book panels and book stops preventing a book from sliding off a book panel. These known devices are designed as functional devices without any attempt to melt a device into the surrounding environment of a study or adapt the same to a local surrounding.

DESCRIPTION OF THE INVENTION

The table top bookstand of the present invention overcomes these and other disadvantages of known devices. The support of the book panel includes a pedestal plate and a center post linking pedestal plate and book panel. The top end of the center post is cut at an angle which determines the slant of the book panel. At the lower end of the top side of the panel there is a book stop across the width of the panel.

The present invention is a family of table top bookstands with interchangeable upper and lower assemblies each of which have necessary optional components. The full set of optional combinations yields sixteen complete and distinct bookstands that share a common motif, viz., a square or round pedestal joined to a cylindrical post whose bottom is perpendicular to the axis of the post and whose top is an inclined plane to which the book panel is attached. A necessary optional feature of the book panel is its book stop, which can be mounted flush to the panel with short dowels or raised from the panel with cylindrical spindles in the manner of a galley rail. Another panel option is an attachable hooded lamp accessory whose flex-arm mounting bracket attaches to the underside or the upper edge of the book panel by means of two thumbscrews which are already assembled as finiols in appropriately spaced threaded inserts in the book panel. When and if the lamp is removed from the panel, the thumbscrews are inserted in the inserts. Freestanding bookstands can be made with square or round pedestals which are made from square or round pedestal blanks with countersunk mounting holes at their centers. An optional feature of the pedestal is the attachment—into a routed recess of the pedestal underside—of a disc assembly, which provides a revolving capability to an otherwise freestanding bookstand. The hardly visible recessed bearing disc helps to project the illusion of a bookstand on a air bearing pedestal.

All the assemblies can be knockdown units when the book panel and the post each incorporate the required threaded inserts.

The pedestal may be equipped with a partially recessed rotary support to allow rotating the pedestal and the panel. Recessing the support in the pedestal reduces the height of the device while generating a floating image of the device.

Provisions are made to attach a reading light, preferably a light fixture with a flexible gooseneck, to the underside or rear edge of the book panel.

OBJECTS OF THE INVENTION

It is an object of this invention to provide a plurality of bookstands of different sizes, forms and optional features, which can be assembled in accordance with one basic procedure, a few optional assembly steps, and basic components of different styles and sizes.

DESCRIPTION OF THE PREFERRED EMBODIMENT

Figure 1:
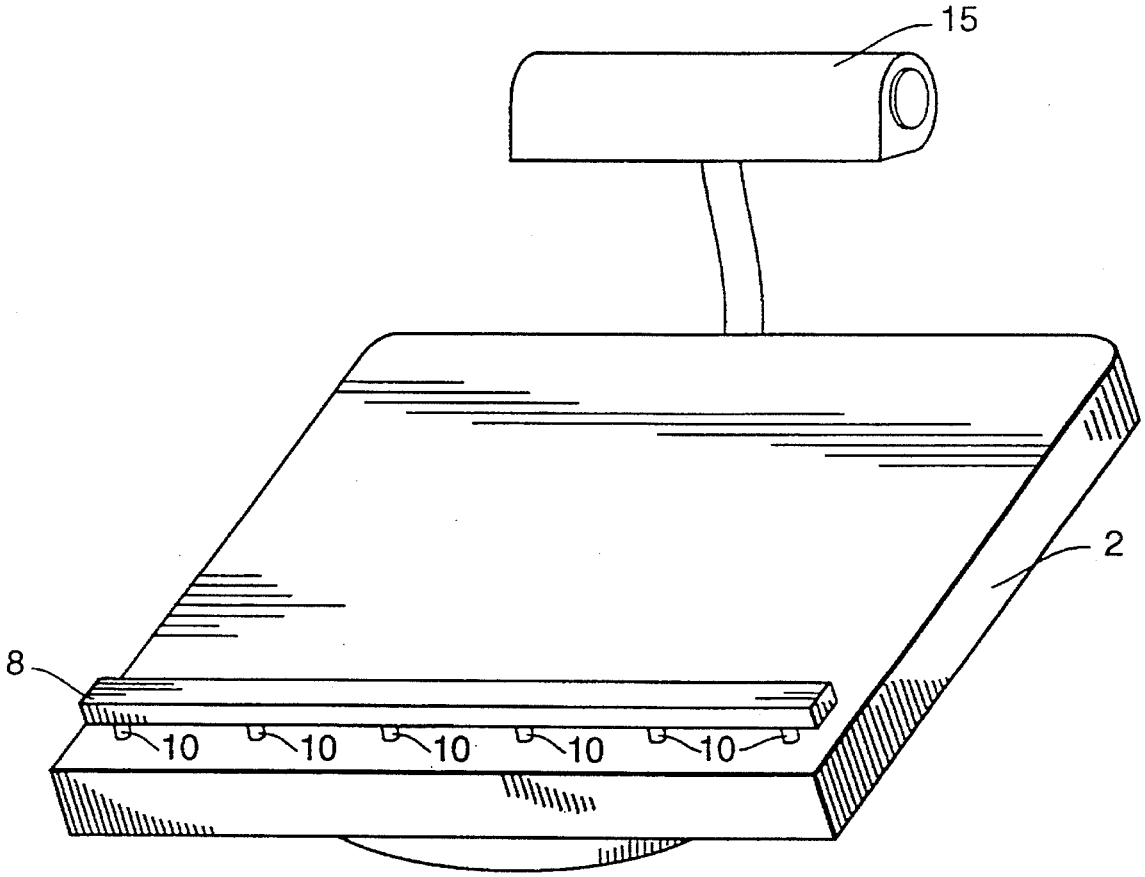
FIG. 1 is a front view illustration of the bookstand of the present invention, including the optional reading lamp.
Figure 2:
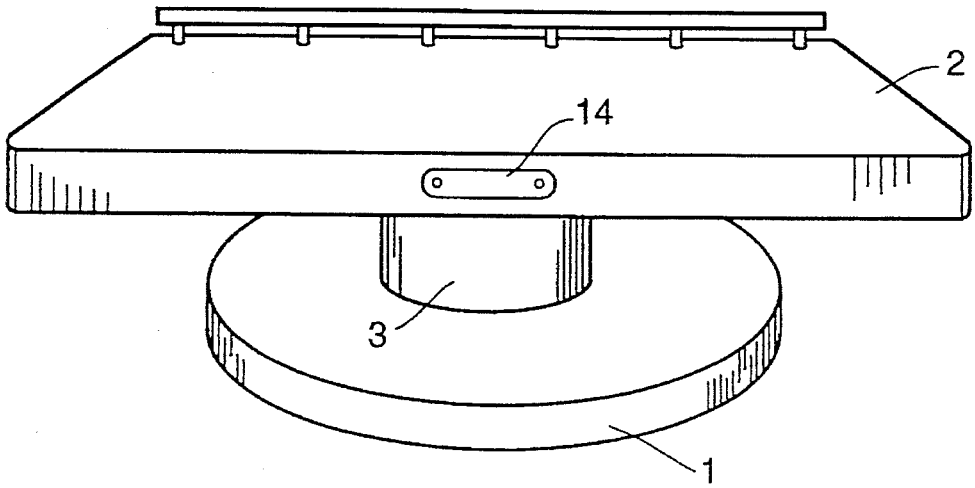
FIG. 2 is a rear view illustration of the bookstand.

FIGS. 1 and 2 is front and rear view illustration of the preferred embodiment of the present invention. Main elements of the table top bookstand are pedestal 1, book panel 2 and cylindrical post 3 interconnecting pedestal 1 and book panel 2. Post 3 is mounted substantially perpendicular to pedestal 1. Upper end 4 of post 3 is cut at the angle at which book panel 2 is to be inclined.

Pedestal 1 may have a circular foot print with a diameter slightly smaller than the short dimension of book panel 2. However, pedestal 1 may also have a square footprint with the height and width slightly smaller than the short dimension of the book panel 2.

Figure 4:
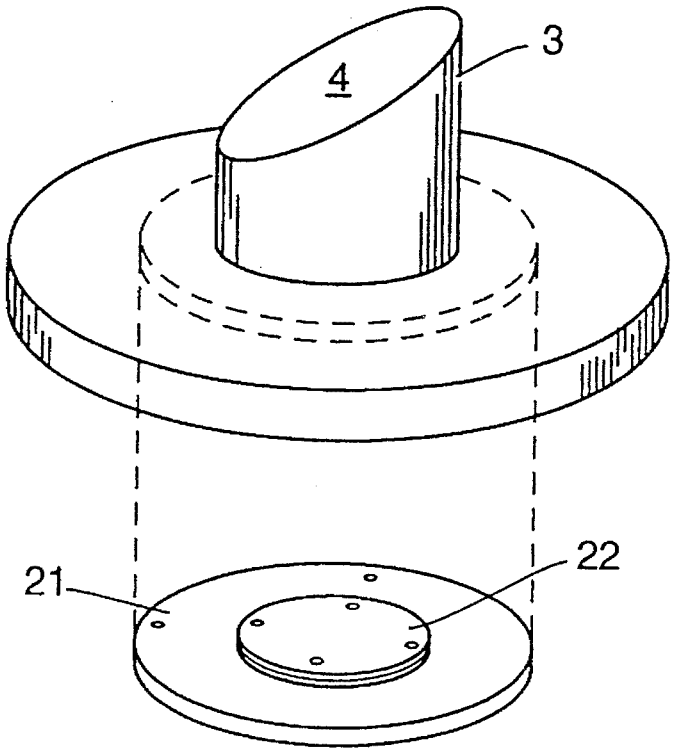
FIG. 4 is an exploded view illustration of the post and pedestal-plate assembly with an optional rotary pedestal.

Recessed in circular pedestal 1 is an optional rotary support including rotary attachment means 22 and disc 21 (see FIG. 4). The rotary support extends from pedestal 1 by an amount necessary to assure unrestricted rotation on a slightly uneven surface or if the device is placed on a mat.

Figure 3:
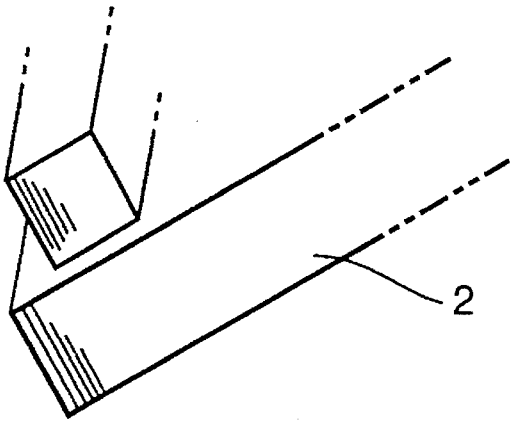
FIG. 3 is partial view illustration of a flush mounted book stop.

Book panel 2 has a book stop including either a top rail 8 on long support posts 10, or a straight rectangular book stop having short support posts, therefore being mounted flush on panel 2, as shown in FIG. 3. Short posts of a flush mounted book stop and long posts of a rail book stop fit into the same mounting holes in panel 2. This allows to assembly bookstands with either type of book stop without additional assembly steps.

A recessed mounting plate 14 or threaded inserts in book panel 2 are provided to affix a reading light 15. This mounting plate or the threaded inserts may be located at the rear edge of panel 2, as shown in FIG. 2, or underneath panel 2, close to the center of the width of book panel 2. Using decorative thumbscrews for affixing a lamp 15 to mounting plate 14 allows to use the same thumbscrews as decorative finiols while no lamp is attached.

Cylindrical post or post 3 is the central part in the assembly. It includes first mounting means for attachment to panel 2, and second mounting means for attachment to pedestal 1. The assembly can be secured by screws or pegs. Using a first screw to attache panel 2 to post 3, and a second screw for attaching pedestal 1 to post 3 eliminates the need for any clamps. When using pegs and glue a clamp is required to secure the relative position of panel 2 to pedestal 1 until the glue is dried.

Figure 5:
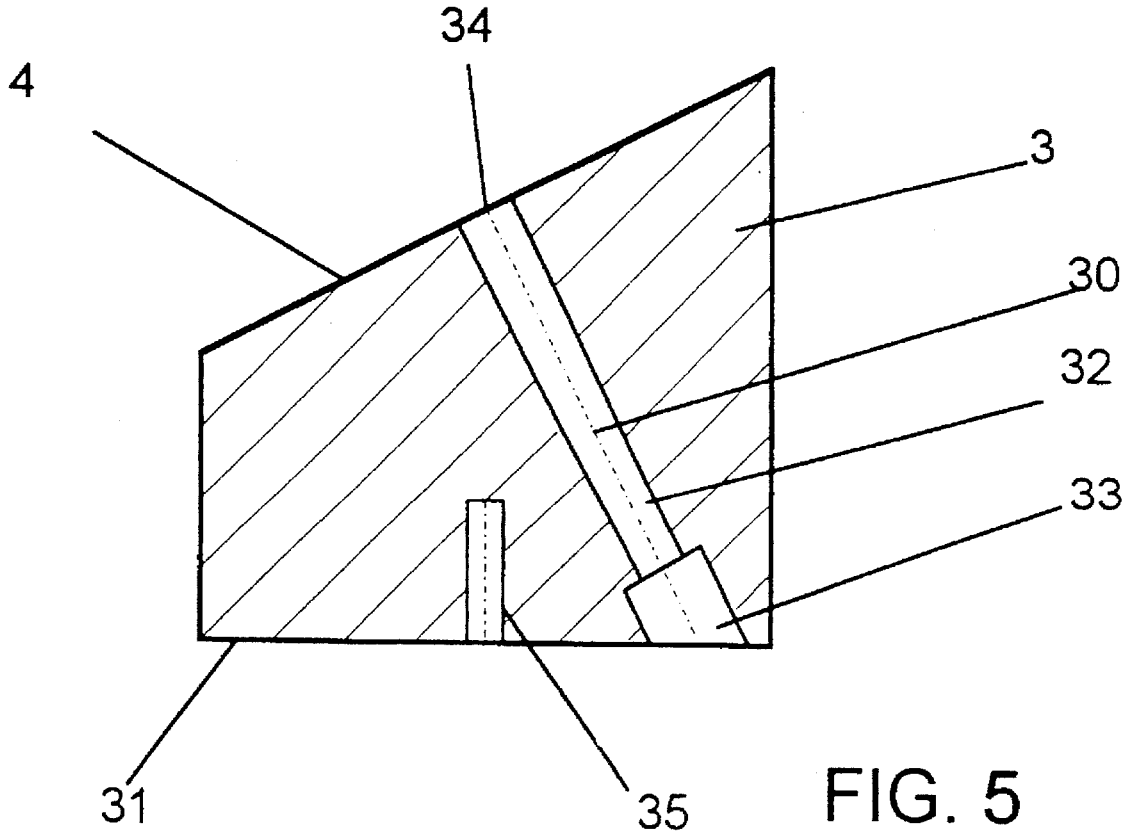
FIG. 5 is an illustration of post between book panel and pedestal.

In the preferred embodiment the assembly is secured by screws. FIG. 5 is an illustration of post 3. A first hole 35 is provided in the center of bottom surface 31. Hole 35 allows the attachment of pedestal 1 to post 3 using either a wood screw or a machine screw, if a threaded insert is assembled in hole 35. A second hole 32 is drilled through post 3 perpendicular to surface 4, beginning in the center of surface 4. At the opposite end, at surface 31, a counterbore 33 is provided. Second hole 32 receives the screw for mounting book panel 2 on surface 4 of post 3. For this purpose book panel 2 has been prepared to receive a mounting screw in the center of its lower surface. To receive a machine screw an insert with a thread of a machine screw is inserted in the center of the lower surface of book panel 2. The head of the assembly screw connecting post 3 with book panel 2 rests inside counterbore 33 and does not interfere with the mounting of post 3 on pedestal 1.

Using this post 3 oriented system of components, it is extremely easy to assemble on the same assembly line bookstands of different configurations, such as bookstands having panels 2 of different sizes, pedestals of different shapes (rectangular or round), pedestals with rotating attachments, and panels with and without reading light.

What I claim is:

1. A table top bookstand comprising a pedestal plate, a book panel, a post interconnecting said pedestal plate and said book panel;

said post having a central axis and a first end having a surface substantially normal to said axis and a slanted end having a surface angled not normal relative to said central axis;

said book panel having a lower edge and an upper edge, a top side and a bottom side, and a rear edge, said book panel and said post having a first type of interface;

said pedestal plate and said post having a second type of interface;

a book stop being attached using pegs in holes at the lower edge of the topside of said book panel;

said pegs being long for a rail type book stop, or short for a flush mounted book stop;

said book panel further including means for attaching a reading light;

said first and said second interface providing for combining differently sized book panels and different types of pedestal plates with said post.

2. A table top bookstand as claimed in claim 1, wherein said pedestal plate includes means for rotating said bookstand around said center axis of said post.

3. A method for assembling a bookstand including a center post interconnecting a pedestal plate and a book panel, said book panel and said center post having a first type of interface, said book panel and said pedestal plate and said center post having a second type of interface, said method including a step of selecting a book panel from a group of book panels of different sizes, said book panels of different sizes all having the same first type of interface with said center post;

a step of selecting a pedestal plate from a group of pedestal plates of different sizes and shapes, said pedestal plates of different sizes and shapes all having the same second type of interface with said center post; and a step of attaching said post to said selected book panel and attaching said selected pedestal plate to said post; thereby providing one assembling method for a large variety of different bookstands from small groups of different book panels and pedestal plates.

4. A method for assembling a bookstand as claimed in claim 3, wherein said selected pedestal plate includes a recessed area, and an additional assembly step is provided for attaching a rotary support in said recessed area to said selected pedestal plate.

5. A method for assembling a bookstand as claimed in claim 3, wherein said selected book panel includes means for attaching a reading light, and wherein an additional step is provided for attaching a reading light to said selected book panel.

6. A method for assembling a bookstand as claimed in claim 3, wherein said selected book panel includes means for attaching a book stop, and wherein said method includes the additional steps of selecting a book stop from a group of different book stops, said different book stops including book stops with long pegs and book stops with short pegs thereby providing either an offset book stop or a flush mounted book stop; and a step for attaching said selected book stop to said book panel;

thereby providing a book panel with either an offset book stop or a flush mounted book stop.

* * * * *